US011136864B2

(12) United States Patent
Hazelip

(10) Patent No.: US 11,136,864 B2
(45) Date of Patent: Oct. 5, 2021

(54) LINER HANGER WITH NANO-REINFORCED SEALS

(71) Applicant: Halliburton Energy Services, Inc., Houston, TX (US)

(72) Inventor: Gary Lynn Hazelip, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 16/489,787

(22) PCT Filed: Aug. 31, 2018

(86) PCT No.: PCT/US2018/049230

§ 371 (c)(1),
(2) Date: Aug. 29, 2019

(87) PCT Pub. No.: WO2020/046389

PCT Pub. Date: Mar. 5, 2020

(65) Prior Publication Data

US 2020/0378220 A1 Dec. 3, 2020

(51) Int. Cl.
*E21B 43/10* (2006.01)

(52) U.S. Cl.
CPC ..... *E21B 43/106* (2013.01); *E21B 43/108* (2013.01)

(58) Field of Classification Search
CPC .... E21B 43/103; E21B 43/106; E21B 43/108; E21B 33/00; E21B 3/02; E21B 3/03; E21B 3/10; E21B 3/12; E21B 3/1208
See application file for complete search history.

(56) References Cited

U.S. PATENT DOCUMENTS

| | | | | |
|---|---|---|---|---|
| 5,411,085 | A * | 5/1995 | Moore | E21B 17/20 166/242.2 |
| 7,013,998 | B2 | 3/2006 | Ray et al. | |
| 7,363,970 | B2 | 4/2008 | Corre et al. | |
| 7,696,275 | B2 | 4/2010 | Slay et al. | |
| 9,580,981 | B2 | 2/2017 | Zhong et al. | |
| 2004/0231838 | A1* | 11/2004 | Carmody | E21B 43/103 166/207 |
| 2007/0267824 | A1* | 11/2007 | Baugh | E21B 23/01 277/607 |
| 2008/0121436 | A1 | 5/2008 | Slay et al. | |

(Continued)

FOREIGN PATENT DOCUMENTS

WO 2014098885 A1 6/2014

OTHER PUBLICATIONS https://www.ahdictionary.com/word/search.html?q=spike American Heritage Dictionary—Spike (Year: 2020).*

(Continued)

*Primary Examiner* — David Carroll
(74) *Attorney, Agent, or Firm* — Scott Richardson; C. Tumey Law Group PLLC

(57) ABSTRACT

A downhole expandable liner hanger positioned in a subterranean wellbore. The liner hanger may comprise a liner and an expansion element. The expansion element may comprise one or more seal elements bonded to the expansion element in an open-ended containment system, wherein each of the one or more seal elements is a nanoreinforced rubber element comprising a polymer host and a plurality of nanostructures.

20 Claims, 3 Drawing Sheets

(56) References Cited

U.S. PATENT DOCUMENTS

| | | | | |
|---|---|---|---|---|
| 2010/0181729 | A1* | 7/2010 | Slay | B82Y 30/00 277/336 |
| 2012/0312560 | A1 | 12/2012 | Bahr et al. | |
| 2014/0174763 | A1* | 6/2014 | Zhong | E21B 43/108 166/382 |
| 2015/0330178 | A1* | 11/2015 | Williams | E21B 23/06 166/138 |
| 2016/0362967 | A1* | 12/2016 | Mullins | E21B 43/103 |

OTHER PUBLICATIONS

ISRWO International Search Report and Written Opinion for PCT/US2018/049230 dated Jun. 3, 2019.

Netherlands Search Report and Written Opinion for Dutch Application No. NL2023544 dated Jan. 3, 2020.

Zhong, Allen, et al. "OTC-27542-MS Development of a High Hang Weight Expandable Liner Hanger for Deepwater Applications." Offshore Technology Conference, May 4, 2017, pp. 1-14. Houston, TX, USA.

Dolog, Rostyslav, et al. "OTC-27609-MS Nano-Enhanced Elastomers for Oilfield Applications." Offshore Technology Conference, May 4, 2017, pp. 1-11. Houston, TX, USA.

* cited by examiner

LINER HANGER WITH NANO-REINFORCED SEALS

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set casing or liner string. Expandable liner hangers may be "set" by expanding the liner hanger radially outward into gripping and sealing contact with the casing or liner string. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing.

As can be appreciated, the expanded liner hanger should support the substantial weight of the attached tubing string below. For deep and extra-deep wells, subsea wells, etc., the tubing string places substantial axial load on the hanging mechanism engaging the liner hanger to the casing. There is a need for improved methods and apparatus providing an expandable liner hanger having improved sealing performance at elevated temperatures and increased survivability of elastomeric elements while running in-hole.

BRIEF DESCRIPTION OF THE DRAWINGS

For a detailed description of the preferred embodiments of the invention, reference will now be made to the accompanying drawings in which.

DETAILED DESCRIPTION

The present disclosure relates generally to equipment utilized and operations performed in conjunction with a subterranean well and, more particularly, to an improved liner hanger system. More specifically, an improved downhole expandable liner hanger with a nano-reinforced rubber element. The improved liner hanger may comprise a rubber element bonded to a tubular body that may then be expanded in an open-ended environment where only the strength of the rubber element may be available to withstand certain forces for a successful installation. An improvement in the rubber element may improve performance related to sealing and anchoring capacity. Although a reinforced rubber element may result in a lower coefficient of friction, one of ordinary skill in the art should recognize that it is more important that the rubber element remain intact and held firmly in place against the inner diameter of a casing.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but it would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Certain embodiments according to the present disclosure may provide for a single trip liner setting and drilling assembly.

Figure 1:
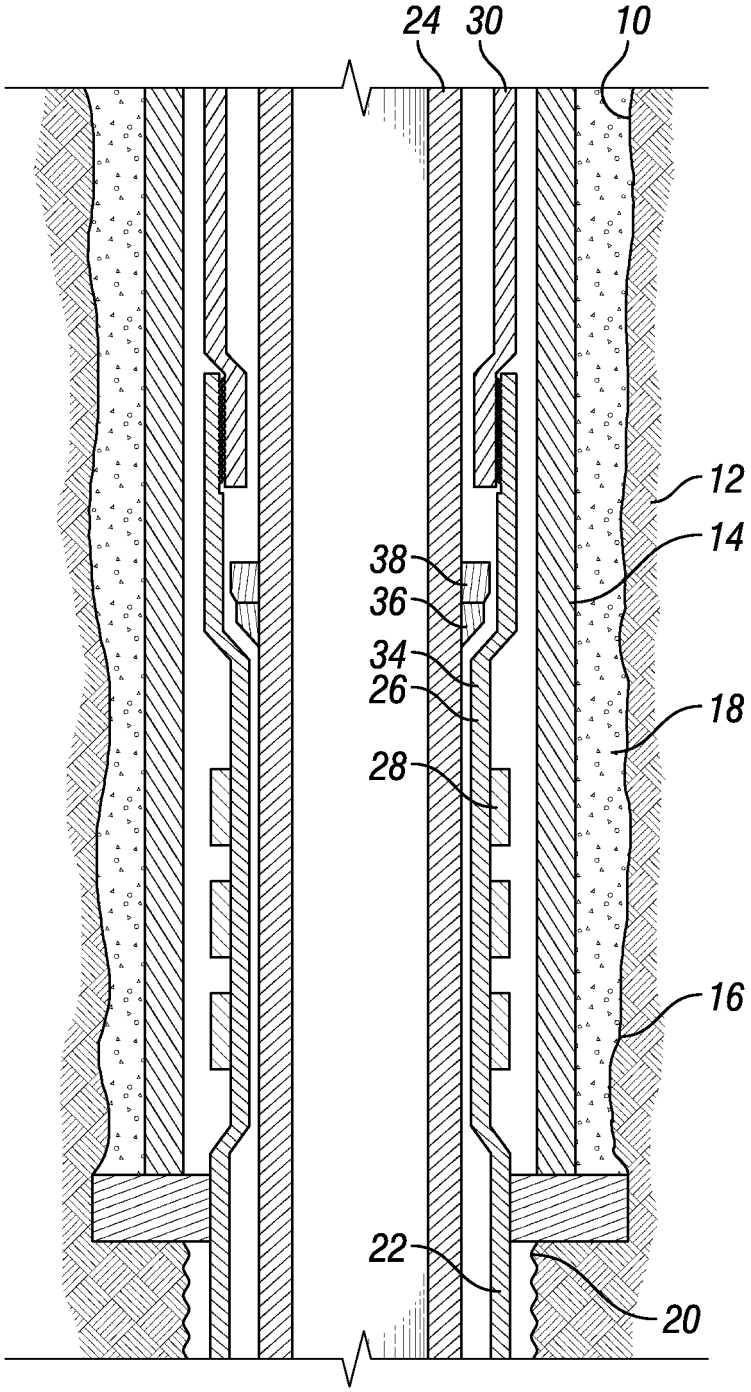
FIG. 1 illustrates an expandable liner hanger.

FIG. 1 illustrates an expandable liner hanger. As shown in FIG. 1, a wellbore 10 may be drilled through an earth formation 12. A casing 14 may then be placed in an upper portion 16 of well 10 and held in place by cement 18, which is injected between casing 14 and upper portion 16 of well 10.

Below casing 14, a lower portion 20 of wellbore 10 may be drilled through casing 14. Lower portion 20 may have a smaller diameter than upper portion 16. A length of a liner 22 is shown positioned within lower portion 20. Liner 22 may be used to line or case lower portion 20 and/or to drill lower portion 20. If desired, cement may be placed between liner 22 and lower portion 20 of wellbore 10. Liner 22 may be installed in wellbore 10 by means of a work string 24.

Attached to the upper end of, or formed as an integral part of, liner 22 is a liner hanger 26, which may include a number of annular seals 28. While three seals 28 are depicted for illustrative purposes, any number of seals 28 may be used.

It is desirable that the outer diameter of liner 22 be as large as possible while being able to lower liner 22 through casing 14. It is also desirable that the outer diameter of a polished bore receptacle 30 and liner hanger 26 be about the same as the diameter of liner 22. In the run-in condition, the outer diameter of liner hanger 26 is defined by the outer diameter of annular seals 28. In the run-in condition, an expansion element 34 of liner hanger 26 has an outer diameter reduced by about the thickness of annular seals 28 so that the outer diameter of annular seals 28 is about the same as the outer diameter of liner 22 and polished bore receptacle 30.

The majority of seal designs utilize a contained system to prevent the rubber element from extruding or moving out of the seal gland. Examples of these seal designs include o-rings, x-seals, t-seals, and packers. Generally, liner hangers are unique because they require conveyance before expansion, which results in an open-ended containment system during in situ expansion.

Applied mechanical stress, fluid stress, temperature, and fluid compatibility all work to reduce the physical properties of rubber elements. When applied to a solid expandable liner hanger, the rubber element must withstand several different scenarios that are unique to the application. During run-in-hole (RIH), the outbound surface of the rubber element is exposed to drilling fluids and the inner surface must remain securely bonded to the tubular. During expansion, the same rubber element must be able to withstand up to a 10% diametrical expansion. Further, the rubber element must support a high compressive load when interacting with the casing and in the case of the standard 12-inch element, a resultant shear force is generated acting to effectively extrude the rubber element. Further, increased temperature degrades mechanical properties needed to withstand all of these scenarios. Thus, once conveyed, the rubber element must withstand extrusion forces at high pressure and temperatures.

While improvements can be made to the manner in which rubber elements are loaded, an improvement in the rubber element can help improve performance in terms of both sealing and anchoring capacity. Although a reinforced rubber element can result in a lower coefficient of friction, it is far more important that the rubber element remain intact and held firmly in place against the inner diameter of the casing.

FIG. 1 further illustrates first and second expansion cones 36 and 38, which may be carried on work string 24 just above reduced diameter expansion element 34 of liner hanger 26. Fluid pressure applied between work string 24 and liner hanger 26 may be used to drive cones 36, 38 downward through liner hanger 26 to expand expansion element 34 to an outer diameter at which seals 28 are forced into sealing and supporting contact with casing 14.

Figure 2:
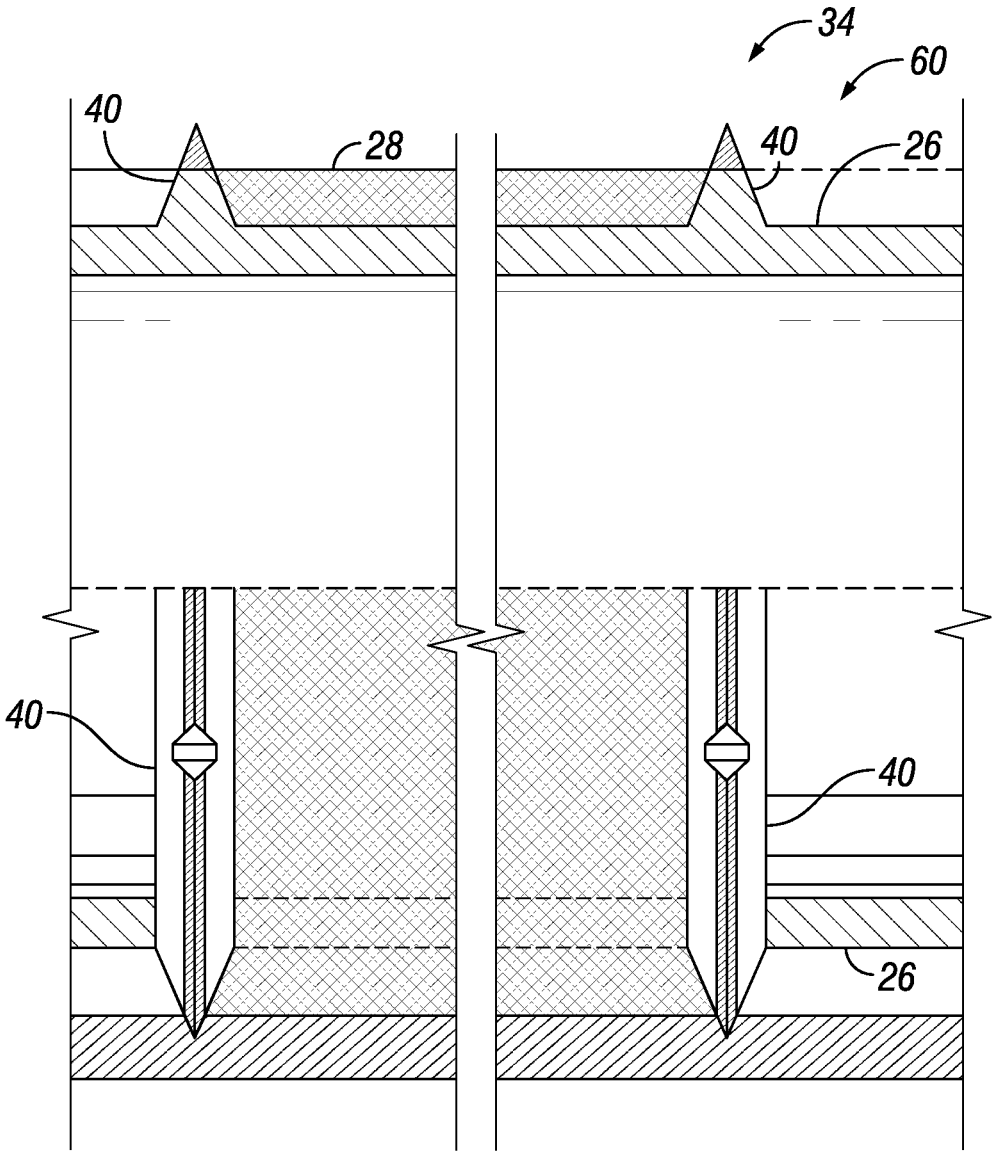
FIG. 2 illustrates a portion of expansion element of liner hanger.

FIG. 2 illustrates a portion of expansion element 34 of liner hanger 26. FIG. 2 further illustrates containment spikes 40. Spikes 40 may be metal spikes. The metal spikes may be made of any suitable steel grade, aluminum, any other ductile material, or a combination thereof. In certain implementations, each spike 40 may be a circular ring that extends along an outer perimeter of liner hanger 26 at a desired axial location. However, the present disclosure is not limited to this particular configuration of spikes 40. For instance, spikes 40 may extend along an axial direction of liner hanger 26. Moreover, in certain implementations, different spikes 40 may have different surface geometries without departing from the scope of the present disclosure. Further, a first spike may extend along an outer perimeter of liner hanger 26 at a first axial position along liner hanger 26 and a second spike may extend along an outer perimeter of liner hanger 26 at a second axial position along liner hanger 26.

FIG. 2 also illustrates seal 28 of liner hanger 26. Annular seals 28 may be made of rubber with nano-reinforcement. Annular seals 28 may comprise a polymer host. More specifically, annular seals 28 may comprise an elastomer. As an elastomer, annular seals 28 may be comprised of nitrile butadiene, carboxylated acrylonitrile butadiene, hydrogenated acrylonitrile butadiene, ethylene propylene, ethylene propylene diene, tetrafluoroethylene and propylene, fluorocarbon, and perfluoroelastomer. Annular seals 28 may also include a plurality of nanostructures selected from a group consisting of polysilane resins, polycarbosilane resins, polysislsequioxane resins, and polyhedral oligomeric silsesquioxane resins. Nanostructures may further include metal oxides, nanoclays, and carbon nanostructures, or even silicon. A polymer host material and nanostructures may have interfacial reactions including copolymerization, van der Waals bonding, and cross-linking interactions. The scope of rubber reinforcement may be within the nano scale at 0.1 nm to 500 nm.

Figure 3A:
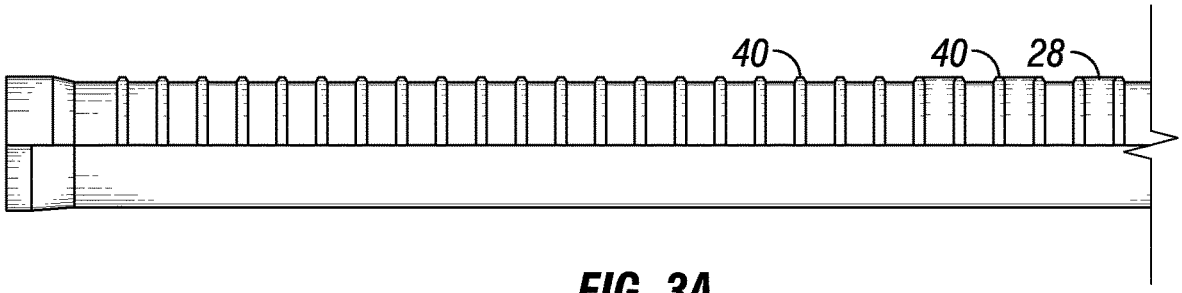
FIG. 3*a* illustrates an example of an expandable liner-hanger with spikes and seals.
Figure 3B:
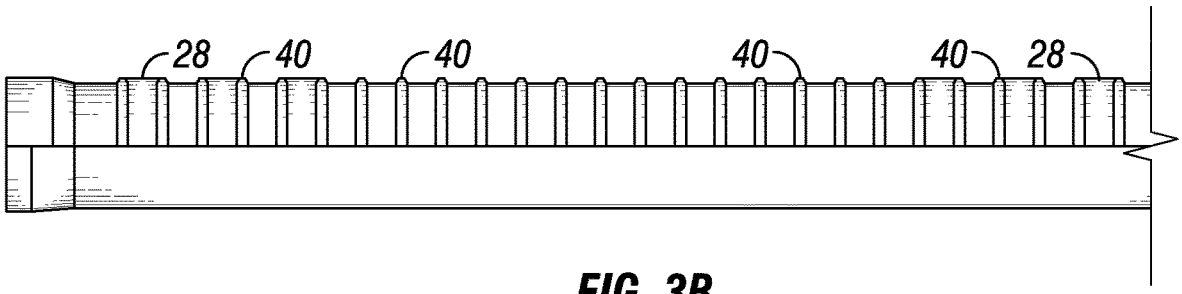
FIG. 3*b* illustrates an example of an expandable liner hanger with spikes and seals at both ends of the liner hanger.

In accordance with this implementation, seals 28 may be positioned at a desired location and utilized in conjunction with spikes 40. Generally, in the downhole setting, elements with pressure from above (uphole) are typically "boosted" or enhanced because of the pressure on the inner diameter of the liner hanger. Elements with pressure from below (downhole) are typically placed in collapse, thus reducing the contact stress and liner hanger performance when reacting to load from below (downhole). The pressure from below (downhole) may be sealed off by placing one or more seals 28 on the bottom of liner hanger 26—thus limiting the influence of collapse pressure—as illustrated in FIG. 3*a*. Further, trapped pressure from expansion of liner hanger 26, which would have a negative influence in the annular space between seals 28, may be avoided—thus avoiding decreased performance of one or more spikes 40. In another embodiment, as illustrated in FIG. 3*b* one or more seals 28 may be placed above the one or more spikes 40 as well, thereby limiting the ability of pressure to reduce contact stress against casing 14. In certain scenarios, pressures may be directed from below (downhole) or above (uphole) and/or combined with varying internal pressures—all of which may impact the contact stress that liner hanger 26 has against the inner diameter of casing 14. The placement of one or more seals 28 at one or both of the distal ends of liner hanger 26 may provide redundancy and pressure integrity for the system.

Accordingly, once wellbore 10 is drilled in a subterranean operation, it may be cased using methods and systems known to those of ordinary skill in the art. For instance, casing 14 may be lowered into wellbore 10 and cemented in place. Liner 22 coupled to liner hanger 26 in accordance with an implementation of the present disclosure may then be lowered downhole through casing 14. Once liner 22 reaches a desired position downhole, the expansion element 34 of liner hanger 26 may expand. Once liner hanger 26 expands, seals 28 may form a seal with the inner surface of casing 14. This seal may couple liner 22 to casing 14.

Accordingly, this disclosure describes systems and methods that may relate to subterranean operations. The systems and methods may further be characterized by one or more of the following statements:

Statement 1: A downhole expandable liner hanger positioned in a subterranean wellbore, comprising: a liner; and an expansion element, comprising: one or more seal elements bonded to the expansion element in an open-ended containment system, wherein each of the one or more seal elements is a nanoreinforced rubber element comprising a polymer host and a plurality of nanostructures.

Statement 2: The liner hanger of statement 1, wherein the polymer host is an elastomer.

Statement 3: The liner hanger of statement 1 or 2, wherein the one or more seal elements engage a downhole tubular, and further wherein the one or more seal elements bear the axial load placed on the liner hanger.

Statement 4: The elastomer of any of the preceding statements, wherein the elastomer comprises nitrile butadiene.

Statement 5: The liner hanger of any of the preceding statements, wherein the plurality of nanostructures comprises polysilane resins.

Statement 6: The liner hanger of any of the preceding statements, wherein each of the plurality of nanostructures has a scale in the range of 0.1 nm to 500 nm.

Statement 7: A downhole expandable liner hanger positioned in a subterranean wellbore, comprising: a liner; and an expansion element, comprising: one or more spikes; and one or more seal elements bonded to the expansion element in an open-ended containment system, wherein each of the one or more seal elements is a nanoreinforced rubber element comprising a polymer host and a plurality of nanostructures.

Statement 8: The liner hanger of statement 7, wherein the polymer host is an elastomer.

Statement 9: The liner hanger of statement 7 or 8, wherein the one or more seal elements engage a downhole tubular, and further wherein the one or more seal elements bear the axial load placed on the liner hanger.

Statement 10: The elastomer of any one of statements 7 to 9, wherein the elastomer comprises carboxylated acrylonitrile butadiene.

Statement 11: The liner hanger of any one of statements 7 to 10, wherein the plurality of nanostructures comprises polycarbosilane resins.

Statement 12: The liner hanger of any one of statements 7 to 11, wherein each of the plurality of nanostructures has a scale in the range of 0.1 nm to 500 nm.

Statement 13: A downhole expandable liner hanger positioned in a subterranean wellbore, comprising: an expansion element comprising: one or more spikes; and one or more seal elements bonded to the expansion element in an open-ended containment system, wherein each of the one or more seal elements is a nanoreinforced rubber element comprising a polymer host and a plurality of nanostructures.

Statement 14: The liner hanger of statement 13, wherein the polymer host is an elastomer.

Statement 15: The liner hanger of statement 13 or 14, wherein the one or more seal elements engage a downhole tubular, and further wherein the one or more seal elements bear the axial load placed on the liner hanger.

Statement 16: The elastomer of any one of statements 13 to 15, wherein the elastomer comprises hydrogenated acrylonitrile butadiene.

Statement 17: The liner hanger of any one of statements 13 to 16, wherein the plurality of nanostructures comprises polysislsequioxane resins.

Statement 18: The liner hanger of any one of statements 13 to 17, wherein each of the plurality of nanostructures has a scale in the range of 0.1 nm to 500 nm.

The benefits of the present disclosure include improving the sealing performance of prior designs that have failed to seal at elevated temperatures; increasing the survivability of elastomeric elements while running in-hole; improving design predictability through improved mechanical properties including shear resistance and bulk modulus.

Although the figures depict embodiments of the present disclosure in a particular orientation, it should be understood by those skilled in the art that embodiments of the present disclosure are well suited for use in a variety of orientations. Further, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A downhole expandable liner hanger comprising:
a liner;
a plurality of spikes, each spike including a tip; and
an expansion element comprising:
seal elements bonded to the expansion element in an open-ended containment system, wherein each seal element is a nanoreinforced rubber element comprising a polymer host and a plurality of nanostructures, wherein the nanoreinforced rubber element is disposed between a first spike and a second spike, the nanoreinforced rubber element operable to expand up to 10% diametrically along the first and second spikes and operable to cover tapered portions of the first and second spikes in an anchored and expanded position.

2. The liner hanger of claim 1, wherein the polymer host is an elastomer.

3. The liner hanger of claim 1, wherein each of the seal elements engages a downhole tubular, and further wherein each of the seal elements bears the axial load placed on the liner hanger.

4. The liner hanger of claim 2, wherein the elastomer comprises nitrile butadiene.

5. The liner hanger of claim 1, wherein the plurality of nanostructures comprises polysilane resins.

6. The liner hanger of claim 1, wherein each of the plurality of nanostructures has a scale in the range of 0.1 nm to 500 nm.

7. A downhole expandable liner hanger comprising:
a liner; and
an expansion element, comprising:
a plurality of spikes, each spike including a tip; and
seal elements bonded to the expansion element in an open-ended containment system, wherein a seal element is a nanoreinforced rubber element comprising a polymer host and a plurality of nanostructures, wherein the nanoreinforced rubber element is disposed between a first spike and a second spike, the nanoreinforced rubber element operable to expand up to 10% diametrically along the first and second spikes and operable to cover tapered portions of the first and second spikes in an anchored and expanded position;
wherein a second seal element is a second nanoreinforced rubber element comprising a second polymer host and a second plurality of nanostructures, wherein the second nanoreinforced rubber element is disposed between the second spike and a third spike, the second nanoreinforced rubber element operable to expand up to 10% diametrically along the second and third spikes and operable to cover tapered portions of the second and third spikes in an anchored and expanded position.

8. The liner hanger of claim 7, wherein each polymer host is an elastomer.

9. The liner hanger of claim 7, wherein each of the seal elements engages a downhole tubular, and further wherein each of the seal elements bears the axial load placed on the liner hanger.

10. The liner hanger of claim 8, wherein each elastomer comprises carboxylated acrylonitrile butadiene.

11. The liner hanger of claim 7, wherein each plurality of nanostructures comprises polycarbosilane resins.

12. The liner hanger of claim 7, wherein each of the plurality of nanostructures has a scale in the range of 0.1 nm to 500 nm.

13. A downhole expandable liner hanger comprising:

an expansion element comprising:

a plurality of spikes, each spike including a tip; and seal elements bonded to the expansion element in an open-ended containment system, wherein a seal element is a nanoreinforced rubber element comprising a polymer host and a plurality of nanostructures, wherein each plurality of nanostructures comprises polysislsequioxane resins, wherein the nanoreinforced rubber element is disposed between the first spike and the second spike, the nanoreinforced rubber element operable to expand up to 10% diametrically along the first and second spikes and operable to cover tapered portions of the first and second spikes in an anchored and expanded position; and wherein a second seal element is a second nanoreinforced rubber element comprising a second polymer host and a second plurality of nanostructures, wherein the second nanoreinforced rubber element is disposed between a third spike and a fourth spike, the second nanoreinforced rubber element operable to expand up to 10% diametrically along the third and fourth spikes and operable to cover tapered portions of the third and fourth spikes in an anchored and expanded position.

14. The liner hanger of claim 13, wherein each polymer host is an elastomer.

15. The liner hanger of claim 13, wherein each of the seal elements engages a downhole tubular, and further wherein each of the seal elements bears the axial load placed on the liner hanger.

16. The liner hanger of claim 14, wherein each elastomer comprises hydrogenated acrylonitrile butadiene.

17. The liner hanger of claim 1, wherein each elastomer comprises carboxylated acrylonitrile butadiene.

18. The liner hanger of claim 13, wherein each of the plurality of nanostructures has a scale in the range of 0.1 nm to 500 nm.

19. The liner hanger of claim 1, wherein a third spike and a fourth spike are not adjacent to any nanoreinforced rubber element.

20. The liner hanger of claim 1, wherein the nanoreinforced rubber element is operable to contact a sidewall of each spike upon expansion.

* * * * *